US008438892B2

(12) United States Patent
Yamamoto et al.

(10) Patent No.: US 8,438,892 B2
(45) Date of Patent: May 14, 2013

(54) STEM SLIDE DEVICE

(75) Inventors: Takeharu Yamamoto, Yamaguchi (JP); Yasuo Katoh, Yamaguchi (JP)

(73) Assignee: Ube Machinery Corporation, Ltd. (JP)

( * ) Notice: Subject to any disclaimer, the term of this patent is extended or adjusted under 35 U.S.C. 154(b) by 500 days.

(21) Appl. No.: 12/443,188

(22) PCT Filed: Aug. 8, 2007

(86) PCT No.: PCT/JP2007/065878

§ 371 (c)(1), (2), (4) Date: Mar. 27, 2009

(87) PCT Pub. No.: WO2008/050523

PCT Pub. Date: May 2, 2008

(65) Prior Publication Data

US 2010/0024509 A1 Feb. 4, 2010

(30) Foreign Application Priority Data

Oct. 16, 2006 (JP) ..... 2006-281397

(51) Int. Cl.
*B21C 26/00* (2006.01)

(52) U.S. Cl.
USPC ..... 72/273; 72/263

(58) Field of Classification Search ..... 72/253.1, 72/257, 273, 259–269, 272, 447
See application file for complete search history.

(56) References Cited

U.S. PATENT DOCUMENTS

| | | | | | |
|---|---|---|---|---|---|
| 3,408,743 | A * | 11/1968 | Piper | 33/203.12 |
| 3,488,807 | A * | 1/1970 | Vossen | 425/192 R |
| 3,716,323 | A * | 2/1973 | Classen | 425/451.2 |
| 3,827,271 | A * | 8/1974 | Kishino et al. | 72/273.5 |
| 4,103,529 | A * | 8/1978 | Huertgen et al. | 72/273.5 |
| 4,342,212 | A * | 8/1982 | Sibler | 72/255 |
| 4,631,945 | A * | 12/1986 | Hulings et al. | 72/43 |
| 4,785,652 | A | 11/1988 | Stewart | |
| 5,247,821 | A | 9/1993 | Bertoli | |
| 5,335,528 | A * | 8/1994 | Cristiani | 72/263 |
| 5,445,004 | A * | 8/1995 | Nannini et al. | 72/272 |
| 5,465,935 | A * | 11/1995 | Wilbs | 248/316.3 |
| 5,836,190 | A * | 11/1998 | Wompner et al. | 72/255 |
| 6,712,671 | B2 * | 3/2004 | Wallendorf et al. | 451/11 |
| 7,434,505 | B2 * | 10/2008 | Suzuki et al. | 100/43 |
| 7,748,756 | B2 * | 7/2010 | Kanamaru et al. | 292/80 |
| 2004/0154858 | A1 * | 8/2004 | Ozsoylu et al. | 180/444 |

FOREIGN PATENT DOCUMENTS

| | | |
|---|---|---|
| JP | 49-9035 B | 3/1974 |
| JP | 2-500008 | 1/1990 |
| JP | 4-231110 A | 8/1992 |
| JP | 8-206727 A | 8/1996 |

* cited by examiner

*Primary Examiner* — Edward Tolan
*Assistant Examiner* — Homer Boyer
(74) *Attorney, Agent, or Firm* — DLA Piper LLP (US)

(57) ABSTRACT

A stem slide apparatus comprises a stem slide base (73) with a stem (6) horizontally mounted thereon to press a billet (B) mounted on a container (5), a slide guide member (72, 72*a*, 72*b*) mounted on a vertical stem move support member (71) and formed with guide grooves in which the side end portions of the stem slide base are fitted and vertically slid, and a lock means (77*a*, 77*b*) arranged on the slide guide member to press the side end portions of the stem slide base. The stem slide apparatus further comprises a drive mechanism (10) having an electric motor (11) to move the slide base in the sliding direction. Therefore the indirect cause of a fire is removed and the maintenance work simplified.

8 Claims, 4 Drawing Sheets

STEM SLIDE DEVICE

TECHNICAL FIELD

This invention relates to a stem slide apparatus arranged on an extrusion pressing machine, or in particular, to a stem slide apparatus in which a stem slide base having mounted thereon a horizontal stem for pressing the billet loaded in a container is moved up at the time of supplying the billet.

BACKGROUND ART

Generally, in the case where an extrusion material (billet) of a metal, such as aluminum or an alloy thereof is extruded by an extrusion pressing machine, a stem is mounted at the forward end portion of a main ram driven by a hydraulic cylinder, and with the container pressed against a dice, the billet on the billet loader is pressed by the stem at the forward end portion of the main ram and loaded in the billet accommodation unit of the container. By driving the main ram further forward with the hydraulic cylinder, the billet is strongly pressed by the stem. Then, a molded product is extruded from the dice outlet.

In this conventional extrusion pressing machine, the forward end of the stem is required to be retreated by the length of the billet when the billet is loaded in the container, and therefore the stroke of the main ram is equal to the sum of the billet length and the stem length. To secure the stroke of the main ram, the entire length of the conventional extrusion pressing machine is increased, which in turn increases the size of the hydraulic cylinder for driving the main ram. Thus, a greater amount of the working oil is required to operate the machine.

In recent years, a compact extrusion press has been designed. The compactness can save the space occupied arid energy consumed by the extrusion pressing machine. An extrusion pressing machine known as a short stroke press type has been developed as One technique for achieving compactness. In the conventional extrusion pressing machine, the space for supplying the billet is required to load the billet in the container, and the stroke of the main ram is lengthened correspondingly. In view of this, in the pressing machine of a short stroke press-type, the mariner in which the billet is supplied is designed so that the stroke of the main ram is shortened by the length of the billet-supplying space.

According to the short stroke press system, the extrusion pressing machine as a whole can be shortened into a compact form along with the non-extrusion time (idle time). Further, the amount of the working oil of the hydraulic cylinder for driving the main ram can be reduced. As a result, the space occupied and energy consumed by the extrusion pressing machine can be saved.

The short stroke press system can be classified into two types according to the direction in which the billet is supplied with respect to the container. One is the short stroke press system called the front loading type. In this front loading type, the container is moved to the stem side at the time of supplying the billet to secure the billet-supplying space on the side nearer to the dice from the container position after movement. In other words, the billet is supplied between the dice and the forward end of the stem.

In the press system of this front loading type, the billet is supplied by "sandwiched charge", and therefore since it is important to maintain the center accuracy of the billet loader unit, the maintenance and control of the billet loader unit are required. The accuracy of the diameter, the curve arid the end surface of the billet is also required. Actually, these requirements are met by increasing the inner diameter of the container. The increased inner diameter, however, is a major cause of taking the blister in the product.

The other type that has been developed is the short stroke press system known as a rear loading type as shown in FIG. 3. In this rear loading type, the stem is moved horizontally or upward to secure the billet-supplying space at the time of supplying the billet. From the initial stem position, the stem is moved horizontally or upward to provide the billet-supplying space on the side of or under the stem on the stem side of the container. The billet is supplied into this space. (See Japanese Unexamined Patent Publication No. 4-231110 and Japanese Unexamined Patent Publication No. 8-206727).

FIG. 3 shows an outline of the extrusion pressing machine of rear loading and short stroke press type in a configuration as viewed from above the extrusion pressing machine. In this extrusion pressing machine, an end-platen 1 and a cylinder mount block 2 are fixedly coupled to each other by tie rods 3. The end platen 1 has mounted thereon the dice 4 having a die through which the billet is extruded into a product, and the container 5 having a billet accommodation unit C is pressed against the dice 4.

As shown in FIG. 3, the cylinder mount block 2 has mounted thereon a main hydraulic cylinder 8 to move the stem 6 along the axis of the billet accommodation unit C of the container 5. Though not shown, a main ram driven under oil pressure is arranged in the main hydraulic cylinder 8, and a stem support member 7 is mounted at the forward end of the main ram. The stem 6 is mounted on this stem support member 7, so that when the main ram of the main hydraulic cylinder 8 is driven, the stem 6 is moved along the axis of the billet accommodation unit C of the container 5. Incidentally, a mechanism for moving the stem 6 horizontally or downward at the time of supplying the billet is hot shown in FIG. 3.

An example of the uplift mechanism of the stem used for the extrusion pressing machine of rear loading and short stroke press type described above is shown in FIGS. 4A and 4B. In this case, a stem support base shown in FIG. 4A is configured of a stem uplift support member 71, a slide guide member 72, a stem slide base 73 and a stem clamp member 74. The stem slide guide member 72 is fixed on a vertically movable stem support member 71 and has slide grooves along which the side ends of the stem slide base 73 are slidable vertically.

The base portion of the stem 6 is clamped by the stem clamp member 74 on the stem slide base 73, so that the stem 6 is held and supported horizontally. Further, the stem slide base 73 is vertically moved by the operation of a vertical stem drive hydraulic cylinder 79. Though hot shown, a mechanical stopper is provided to define the lower limit of the stem slide base 73, and the position sensor of the mechanical stopper detects whether the vertical center of the stem 6 has entered a tolerable value or not. FIG. 4A shows the state in which the stem slide base 73 is located at the lower limit, in which the center of the stem 6 is aligned with the axis of the billet accommodation unit C of the container 5.

The billet-supplying operation of the extrusion pressing machine of rear loading type shown in FIG. 5 is explained with reference to FIGS. 5A to 5C. In FIGS. 5A to 5C, the same parts as the extrusion pressing machine shown in FIG. 3 are designated by the same reference numerals, respectively.

First, as shown in FIG. 5A, the stem 6 is moved upward, and the billet B held by the billet loader unit BL is supplied into the space formed under the stem 6 sideways of the extrusion pressing machine at the axial position of the billet accommodation unit C of the container 5. The state in which the stem 6 is moved upward under this condition is shown in FIG. 4B.

In FIG. 4B, the vertical stem drive hydraulic cylinder 79 is activated and the stem slide base 73 is pushed up to a predetermined height from the lower limit position. As the result of the upward movement of the stem slide base 73, the stem 6 clamped to it is also moved up to a predetermined height from the position of axis X. After the stem 6 moves upward, a space is formed at the position on axis X, and the next billet B is pushed out and can be supplied into this space as shown.

Then, as shown in FIG. 5B, me billet insertion unit of the billet loader BL is driven along the axial direction, so that the billet B is inserted and loaded in the billet accommodation unit C of the container 5.

As shown in FIG. 5C, the billet B is further inserted, and when completely loaded in the billet accommodation unit C, the billet loader unit BL is retreated sideways from the extrusion pressing machine and proceeds to hold the next billet. After that, the stem 6 which has been moved up is driven downward and returns to the initial axial position of the billet accommodation unit C. Then, the main hydraulic cylinder 8 is driven and the main ram is advanced, so that the stem 6 begins to press the billet B, after which the extruded billet B is molded by the dice 4.

DISCLOSURE OF THE INVENTION

By the way, in the case where the uplift mechanism with the stem driven by the hydraulic cylinder described above is employed in the extrusion pressing machine of rear loading and short stroke press type, the fact that the drive means for vertically moving the stem is the hydraulic cylinder poses the problem of the oil leakage due to the secular variation or the damage of the hydraulic drive system. In the case where the oil leaks out, a fire may occur due to the proximity between the stem slide mechanism and the heated container in the viscosity of the extrusion ending position of the extrusion pressing machine with the stem advanced. For this reason, the extrusion pressing machine is required to be periodically stopped to conduct maintenance on the hydraulic drive system, thereby posing the problem that the machine is required to stop the operation each time of the maintenance.

Accordingly, it is an object of this invention to provide a stem slide apparatus capable of avoiding the oil leakage risk, simplifying the maintenance work and vertically moving the stem at the time of supplying the billet, even in the case where the stem slide mechanism and the heated container come close to each other in the viscosity of the extrusion ending time of the extrusion pressing machine with the stem advanced.

In order to solve the problem described above, the stem slide apparatus according to this invention comprises a stem slide base with the stem horizontally mounted thereon to press the billet mounted on a container, a slide guide member mounted on a vertically moving stem support member and formed with guide grooves in which the side end portions of the stem slide base are fitted and vertically slid, and a lock means arranged on the slide guide member to press the side end portions of the stem slide base, the apparatus further including a drive mechanism having an electric motor to move the slide base in the sliding direction.

In the stem slide apparatus according to this invention, the drive mechanism preferably includes an electric motor and a ball screw conversion unit haying a threaded shaft and a ball hut for converting the rotation of the output shaft of the electric motor into the linear motion.

In the stem slide apparatus according to this invention, the drive mechanism has the electric motor preferably arranged in parallel on the axis of the ball screw conversion unit.

In the stem slide apparatus according to this invention, the electric motor can also be replaced with an electric servo motor.

As described above, in the stem slide apparatus according to this invention, the space is secured to supply the billet into the container accommodation unit by the upward movement of the stein, the billet is loaded in the container accommodation unit and the press operation of the billet is started in the container accommodation unit by the downward movement of the stem. The stem uplift mechanism for moving the stem in the sliding direction with the stem slide base is configured as a drive mechanism having the electric motor. As a result, the oil leakage due to the secular variation or damage to the hydraulic drive system and danger which otherwise may be caused by the oil leakage can be avoided while at the same time reducing the periodic maintenance work, thereby reducing the requirement to suspend the machine operation.

Since the drive mechanism includes an electric motor and a ball screw conversion unit having a threaded shaft and a ball nut for converting the rotation of the output shaft of the electric motor into the linear motion, the structure is simple and free of a wearing portion on the one hand, and the maintainability is so high that the parts are required to be changed less frequently, while at the same time reducing the machine suspension time one the other hand, thereby contributing to an improved productivity.

Further, since the drive source is configured of an electric motor, the operation controllability and the operability of the stem slide apparatus and the drive efficiency are improved at the same time for a reduced operation energy.

From the accompanying drawings and the description of preferred embodiments of the invention, the present invention will be more fully understood.

BEST MODE FOR CARRYING OUT THE INVENTION

Figure 1:
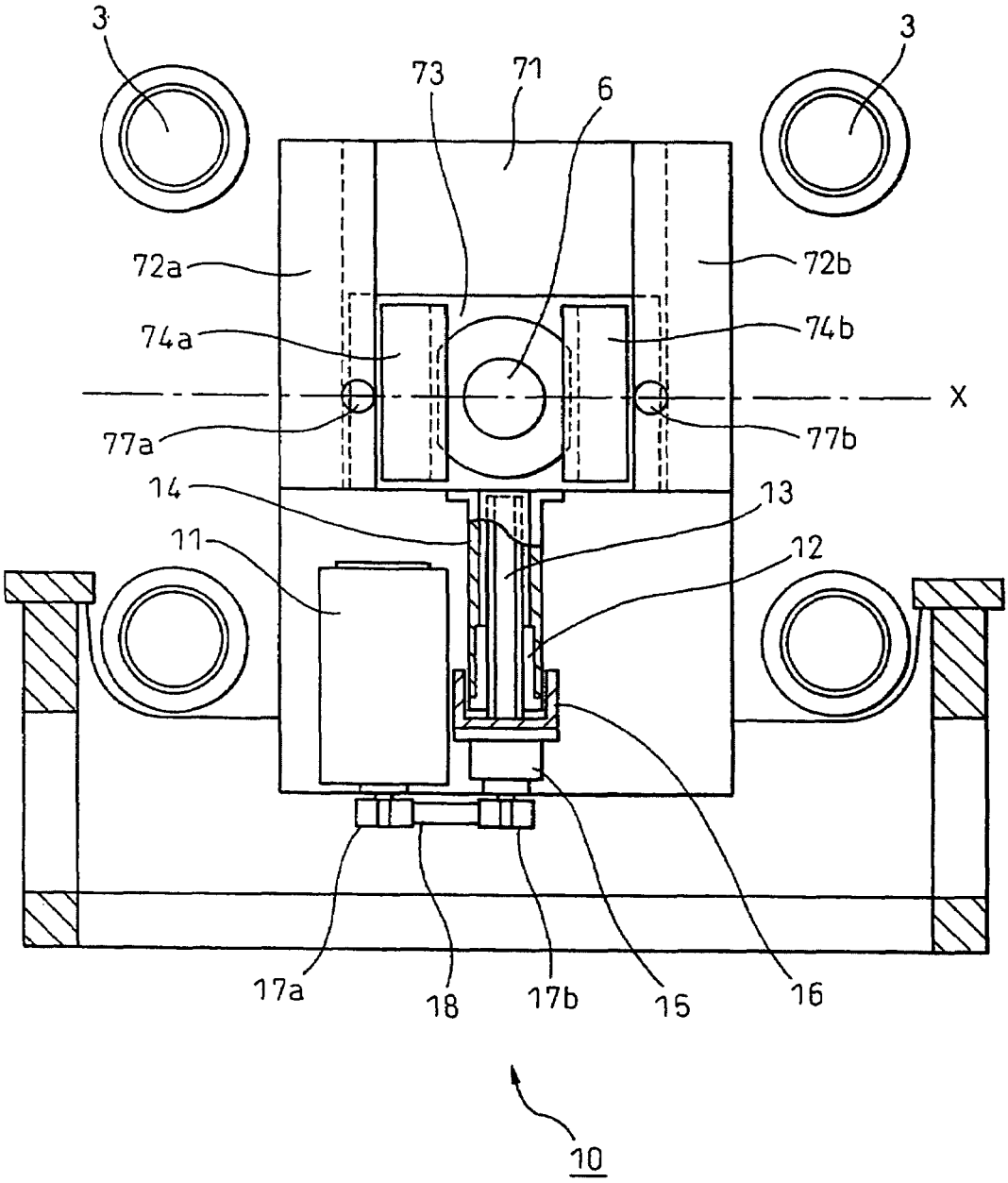
FIG. 1 is a diagram explaining the stem slide apparatus for the extrusion pressing machine according to an embodiment of the invention.
Figure 2:
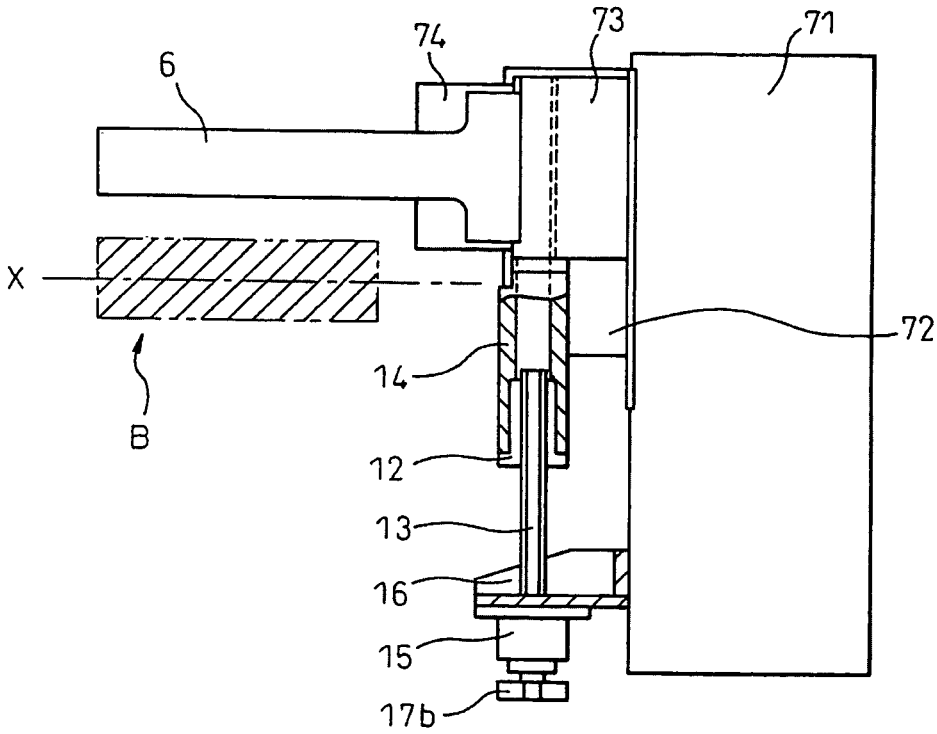
FIG. 2 is a diagram explaining the position to which the stem moves up at the time of supplying the billet in the stem slide apparatus according to an embodiment.

Next, with reference to FIGS. 1 and 2, the stem slide apparatus according to an embodiment of the present invention is explained. The stem slide apparatus according to the present invention is basically used for the extrusion pressing machine of rear loading and short stroke press type described above.

Figure 3:
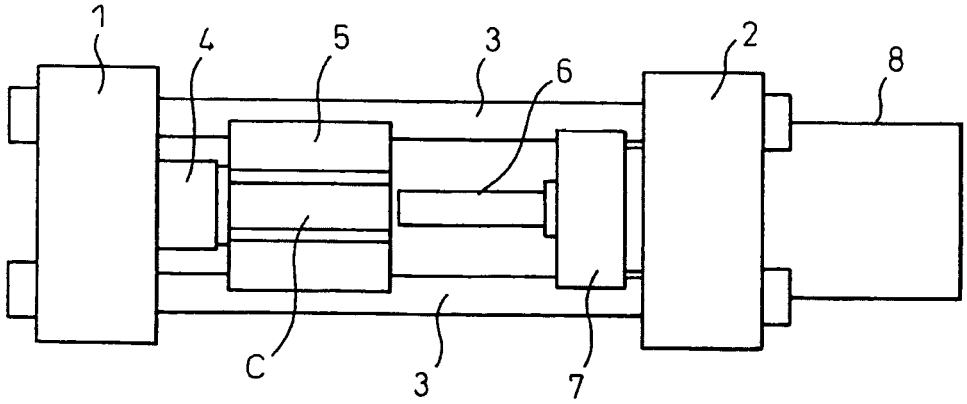
FIG. 3 is a diagram explaining the configuration of the extrusion pressing machine of rear loading type.
Figure 4A:
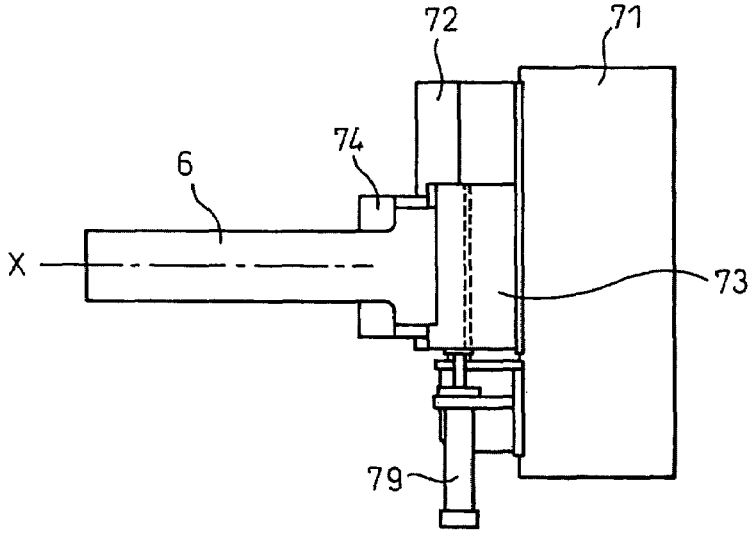
FIGS. 4A and 4B are diagrams explaining the stem slide configuration of the short stroke extrusion pressing machine of rear loading type.
Figure 4B:
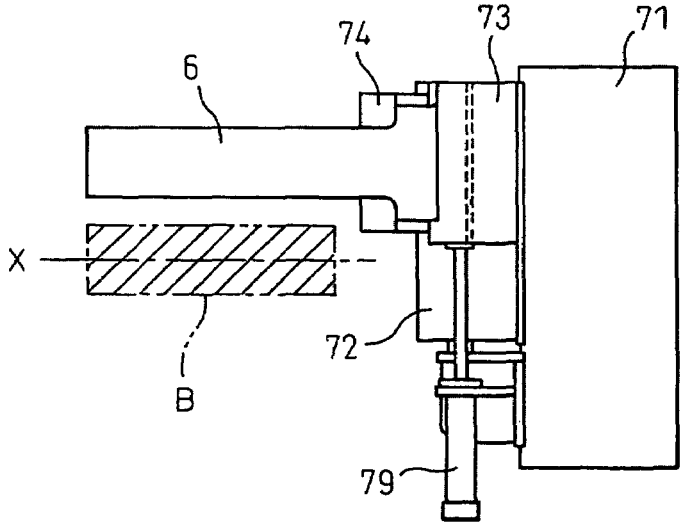

FIG. 1 shows a stem slide apparatus according to an embodiment of the invention. The stem slide apparatus according to the embodiment shown in. FIG. 1 is plotted as a longitudinal sectional view at the position of the forward end portion of the stem of the extrusion pressing machine shown in FIG. 3. FIG. 2 is a diagram for explaining the position to which the stem moved up, and plotted as a cross sectional view at the position of the stem shaft of the stem slide apparatus shown in FIG. 1.

The stem slide apparatus shown in FIG. 1 is basically configured of a vertical stem move support member 71, slide guide members 72*a*, 72*b*, a stem slide base 73 and stem clamp members 74*a*, 74*b*. The slide guide members 72*a*, 72*b* are fixed on the vertical stem move support member 71, and slide grooves are formed between the side members 72*a*, 72*b* and a liner, not shown, arranged on the vertical stem move support member 71. In the slide grooves, the two side end portions of the stem slide base 73 are adapted to slide vertically, respectively. Reference numerals 77*a*, 77*b* designate lock means for pressing the side end portions of the stem slide base.

The stem base portion of the stem 6 is clamped to the stem slide base 73 by the stem clamp members 74*a*, 74*b*, so that the stem 6 is held horizontally. Further, the stem slide base 73 is moved vertically by the operation of the vertical stem move drive mechanism 10.

The vertical stem move drive mechanism 10 according to the embodiment shown in FIG. 1 is basically configured of an electric motor 11, a ball nut 12, a ball screw 13, a ball nut support member 14, a bearing 15, a bearing support member 16, pulleys 17*a*, 17*b* and a timing belt 18.

As shown in FIG. 1, the electric motor 11 with the pulley 17*a* mounted on the output shaft thereof is fixedly arranged under the vertical stem move support member 71. Further, a bearing 15 fixed on the bearing support member 16 is arranged in parallel on the axis of the electric motor 11 under the vertical stem move support member 71, and the ball screw 13 is rotatably supported on the bearing 15. The pulley 17*b* is mounted on the input shaft of the ball screw 13 and coupled to the electric motor 11 through a timing belt 18.

The ball nut 12 is screwed on the threaded shaft 13, and mounted in the ball nut support member 14 fixed, with the movement thereof restricted in rotation and axial directions, at the lower end of the stem slide base 73.

In this configuration, the rotation of the electric motor 11 rotates the threaded shaft 13 and linearly moves the stem slide base 73 through the ball hut 13.

Figure 5A:
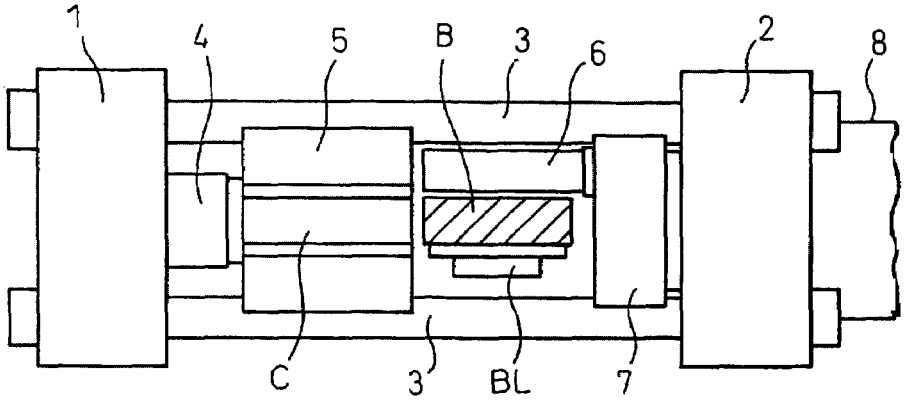
FIGS. 5A to 5C are diagrams explaining the steps of supplying and inserting the billet in the extrusion pressing machine of rear loading type shown in FIG. 3.
Figure 5B:
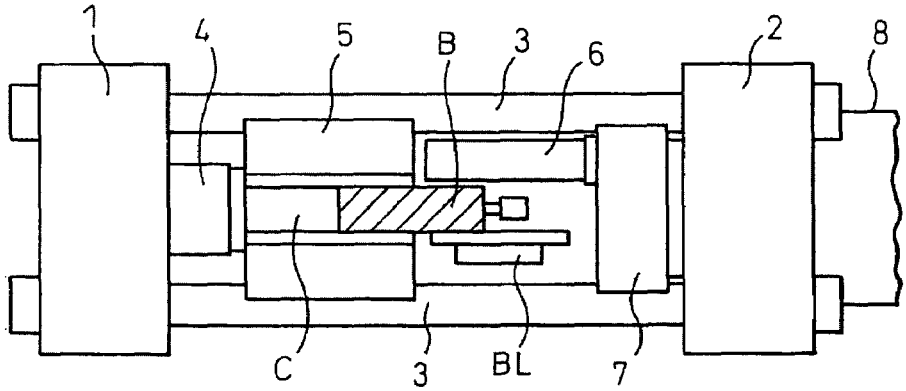
Figure 5C:
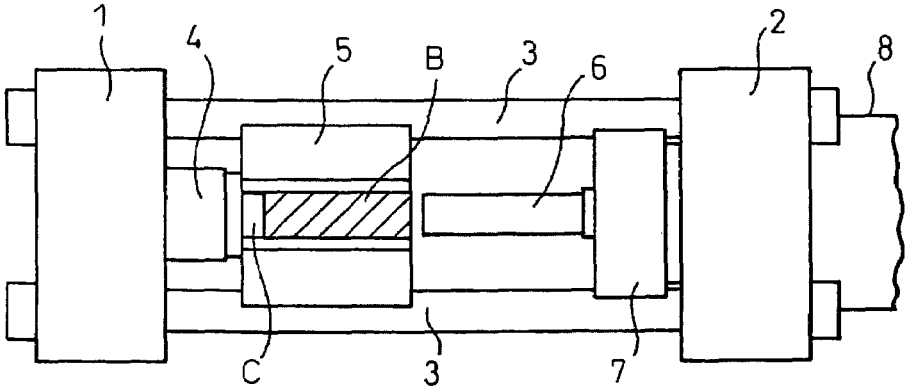

FIG. 2 shows the state in which in order to secure the billet-supplying space at the time of supplying the billet shown in FIG. 5A, the stem is moved upward from the initial position thereof and the billet-supplying space formed on the stem side of the container under the stem. The billet is supplied into this space. The axis designated by X indicates the initial stem position.

According to the embodiment shown in FIG. 1, the stem slide base 73 reaches the lower limit position, and when a mechanical stopper not shown works, the stem slide base 73 is pressed against the vertical stem move support member 71. In this way, the displacement of the center axis of the stem 6 from the axis X of the billet accommodation unit C of the container which otherwise might be caused by the wear of the slide liner, etc. can be corrected. For the purpose of this displacement correction, lock means 77*a*, 77*b* driven are arranged on the slide guide members 72*a*, 72*b* in opposed relation to the side end portions of the stem slide base 73. Upon detection that the stem slide base 73 reaches the lower limit position, therefore, the lock means 77*a*, 77*b* are operated to press the side end portions of the stem slide base 73.

Further, by replacing the electric motor 11 with ah electric servo motor, the motor unit can be reduced in size and a more compact stem slide apparatus is realized as a whole, while at the same time effectively improving the controllability and the operability.

Although the embodiments described above are configured to arrange the electric motor 11 and the ball screw 13 parallel to each other, an alternative configuration may be employed in which the ball nut 12 is mounted in the stem slide base 73, without the ball nut support member 14, in such a manner as to restrict the movement thereof in the rotational and axial direction, the input shaft end of the ball screw 13 and the output shaft end of the electric motor 11 are connected by coupling or otherwise, and the electric motor 11 and the ball screw 13 are arranged in series on the same center. Unlike the embodiments explained above with the configuration in which the electric motor 11 is arranged under the stem slide base 73, the electric motor 11 may alternatively be arranged above the stem slide base 73.

Further, a configuration may be employed in which the speed of the vertical stem movement is regulated and controlled using an inverter and an inverter motor.

DESCRIPTION OF REFERENCE NUMERALS

1 End-platen
2 Cylinder mount block
3 Tie rod
4 Dice
5 Container
6 Stem
7 Stem support base
8 Main hydraulic cylinder
10 Drive mechanism
11 Electric motor
12 Ball nut
13 Ball screw
14 Ball nut support member
15 Bearing
16 Bearing support member
17*a*, 17*b* Pulley
18 Timing belt
71 Vertical stem move support member
72, 72*a*, 72*b* Slide guide member
73 Stem slide base
74, 74*a*, 74*b* Stem clamp member
77*a*, 77*b* Lock means
B Billet
BL Billet loader

The invention claimed is:

1. A stem slide apparatus comprising:

a stem slide base with a stem horizontally mounted thereon to press a billet mounted on a container, a slide guide member mounted on a vertical stem move support member and formed with guide grooves in which side end portions of the stem slide base are fitted and slides upwardly and downwardly along an extrusion axis and in a direction perpendicularly intersecting the extrusion axis, a lock arranged on the slide guide member to press the side end portions of the stem slide base toward the extrusion axis by driving force under oil pressure, and a drive mechanism having an electric motor to move the stem slide base horizontally in an extrusion direction with the stem when extruding the billet.

2. The stem slide apparatus as set forth in claim 1, wherein the drive mechanism includes an electric motor and a ball screw conversion unit having a threaded shaft and a ball nut for converting the rotation of the output shaft of the electric motor into the linear motion.

3. The stem slide apparatus as set forth in claim 1, wherein the drive mechanism has the electric motor arranged in parallel on the axis of the ball screw conversion unit.

4. The stem slide apparatus as set forth in claim 2, wherein the drive mechanism has the electric motor arranged in parallel on the axis of the ball screw conversion unit.

5. The stem slide apparatus as set forth in claim 1, wherein the electric motor is replaced with an electric servo motor.

6. The stem slide apparatus as set forth in claim 2, wherein the electric motor is replaced with an electric servo motor.

7. The stem slide apparatus as set forth in claim 3, wherein the electric motor is replaced with an electric servo motor.

8. The stem slide apparatus as set forth in claim 4, wherein the electric motor is replaced with an electric servo motor.

* * * * *